US005303009A

United States Patent [19]

Nishizawa

[11] Patent Number: 5,303,009

[45] Date of Patent: Apr. 12, 1994

[54] IMAGE FORMING APPARATUS WITH AN IMPROVED DISCHARGER

[75] Inventor: Kimio Nishizawa, Hachioji, Japan

[73] Assignee: Konica Corporation, Tokyo, Japan

[21] Appl. No.: 92,246

[22] Filed: Jul. 14, 1993

[30] Foreign Application Priority Data

Jul. 21, 1992 [JP] Japan ..... 4-194128

[51] Int. Cl.[5] ..... G03G 15/02

[52] U.S. Cl. ..... 355/219; 355/296; 355/326 R; 355/327

[58] Field of Search ..... 355/203, 208, 219, 326, 355/327, 296, 303

[56] References Cited

U.S. PATENT DOCUMENTS

| | | | |
|---|---|---|---|
| 4,945,389 | 7/1990 | Usui et al. | 355/296 |
| 4,949,125 | 8/1990 | Yamamoto et al. | 355/219 |
| 5,107,285 | 4/1992 | Hamada et al. | 355/296 X |
| 5,162,859 | 11/1992 | Hirono et al. | 355/327 X |
| 5,175,584 | 12/1992 | Usui | 355/208 |

*Primary Examiner*—A. T. Grimley
*Assistant Examiner*—William J. Royer
*Attorney, Agent, or Firm*—Frishauf, Holtz, Goodman & Woodward

[57] ABSTRACT

An image forming machine such as a photocopier or a printer for forming a toner image of an original document on a recording sheet. The image forming machine includes a charger for charging a photoreceptor; the photoreceptor, having a surface, for holding a toner image on the surface; a laser beam writer for writing a latent image on the surface of the photoreceptor; a multi-color developer for developing the latent image with a color toner so that a color toner image is formed on the surface in which the color toner image is superimposed for multiple times so that a multi-color toner image is formed on the surface; a mono-color developer for developing the latent image with a monochrome toner so that a monochrome toner image is formed on the surface; a transfer mechanism for transferring one of the multi-color toner image and the monochrome toner image from the surface onto the recording sheet; neutralizer for neutralizing the surface after the transfer mechanism transfers one of the multi-color toner image and the monochrome toner image onto the recording sheet; a cleaner for cleaning a residual toner on the surface after the surface is neutralized by the neutralizer; and a controller for changing a neutralizing voltage of the neutralizer being impressed onto the surface.

3 Claims, 4 Drawing Sheets

IMAGE FORMING APPARATUS WITH AN IMPROVED DISCHARGER

BACKGROUND OF THE INVENTION

The present invention relates to an image forming apparatus such as an electrophotographic copying machine, and more particularly, to an image forming apparatus wherein a toner image obtained through development of a latent image on an image carrier therein is transferred onto a recording sheet through a physical means of a transfer belt device having a rotary transfer belt and then the recording sheet to which the toner image adheres is transported to a fixing means where the toner image is fixed, while the image carrier from which the toner image has been transferred is neutralized electrically by a neutralizer and then is cleaned for the following image formation.

On an image forming apparatus such as an electrophotographic copying machine or the like, the surface of a photoreceptor drum, for example, which is an image carrier is charged evenly by a charging unit and then the surface of the photoreceptor drum is subjected to imagewise exposure for formation of an electrostatic latent image. The latent image is developed by a developing means and visualized to be a toner image. The toner image formed on the circumferential surface of the photoreceptor drum is transferred by a physical means onto a recording sheet which is transported synchronously, and the recording sheet on which the toner image has been transferred is separated from the photoreceptor drum and is transported to a fixing means where the toner image is fixed on the recording sheet. After that, the recording sheet is ejected to the outside of the apparatus.

As a means for transferring the toner image adhering to the circumferential surface of the photoreceptor drum to a recording sheet, a transfer unit that conducts electric discharge on the recording sheet from its back side charges with electricity having polarity opposite to that of toners, the toner image is transferred onto the recording sheet, and the recording sheet is separated from the photoreceptor drum after being neutralized with AC high voltage impressed thereon by a separating unit after the transfer. However, it is difficult to keep for sure the satisfactory conditions of transfer and separation. Especially when the photoreceptor drum has a large diameter, a recording sheet is difficult to be separated and a recording sheet onto which a toner image has been transferred sticks to the photoreceptor drum without being separated, tending to cause sheet jamming, which is a disadvantage. As a technology improving the disadvantage, a transfer belt device is used.

In the transfer belt device, a transfer belt stretched around a plurality of supporting rollers is rotated at the same speed as the photoreceptor drum. The transfer belt device is equipped with a charge-donating means that donates electric charges to a recording sheet so that the recording sheet may be attracted by electrostatic force to the transfer belt, thus the recording sheet is brought into contact with the photoreceptor drum at a transfer section while adhering to the transfer belt, and at the transfer section, high voltage having polarity opposite to that of toners is impressed on the recording sheet under the control of constant current for transferring toner images. Such transfer belt device offers excellent transfer efficiency and excellent separation effect at the transfer section.

For a color image forming apparatus wherein toner images are superimposed on a photoreceptor drum to be transferred onto a recording sheet at once, the transfer belt device mentioned above is used as a device which is especially preferable. In the color image forming apparatus mentioned above, a plurality of developing units are provided around the photoreceptor drum because toner images are superimposed on the photoreceptor, which requires a large drum diameter that needs more positive separation efficiency because sufficient separation efficiency can not be obtained in a conventional electrostatic transfer and separation system. Further, in the system of superimposing toner images, an amount of adhering toners is large and thereby a large amount of electric charges for transfer is required. Therefore, it is necessary to have great capacity for keeping electric charges for transfer. For the two points mentioned above, the transfer belt device is excellent, and therefore, it is used as an especially preferable device.

However, for photoreceptor drum 110 as shown in FIG. 4, corona discharge unit 136 is provided for corona discharge on the back side of transfer belt 131 at nip portion 135 to which the transfer belt 131 stretched around supporting rollers 132 and 134 touches, then, toner images formed on the photoreceptor drum 110 are transferred onto recording sheet sticking to and transported by the transfer belt 131, and after the recording sheet from which images have been transferred is separated from the photoreceptor drum 110, electric charges from corona discharge unit 136 are transferred onto the photoreceptor drum 110 from which the recording sheet has been separated to cause the photoreceptor drum to be in a charged state. When the photoreceptor drum 110 is superordinate for charging, it is not possible to remove sufficiently the toners remaining on and sticking to the photoreceptor drum 110 after transfer even when cleaning means 116 is used for removing them, which is a problem. Therefore, neutralizer 115 is provided to impress AC bias voltage for neutralizing.

An effect of the neutralizer 115 provided can be confirmed in cleaning. According to the study of the inventors of the invention, however, the photoreceptor drum subjected to AC neutralizing by means of simple AC bias voltage and still holding remaining toners thereon is not necessarily cleaned fully by the following cleaning means. Namely, there is observed a phenomenon that a part of remaining toners removed once from the surface of the photoreceptor drum by a cleaning blade in cleaning is scraped up to the tip of the cleaning blade and sticks to the surface of the photoreceptor drum again after being redeveloped. This phenomenon is remarkably observed on a color image forming apparatus of a multi-color type wherein toner images each having a different color are superimposed and formed on the surface of the photoreceptor drum and then are transferred onto a recording sheet. The reason for the phenomenon that the remaining toners cause redeveloping is considered as follows: with regard to electric charges given to the photoreceptor and toners by the corona discharge unit 136, those given to the remaining toners which are in the state of adhering are not neutralized fully by AC neutralization although those given to the photoreceptor whose back side is grounded are neutralized to be zero in voltage by AC neutralization. A phenomenon of redeveloping is observed remarkably at a point of time of pressure-contact and releasing of the cleaning blade.

In a color image forming apparatus having the multi-color function, it is not possible to keep causing the cleaning blade of cleaning means 116 to be in pressure-contact when forming a color image because toner images each having a different color are superimposed and formed on the circumferential surface of photoreceptor drum 110. Namely, after transferring the precedent color images and before forming the following color images, the cleaning blade is brought into pressure-contact for cleaning the circumferential surface of the photoreceptor drum 110, and then the pressure-contact of the cleaning blade is released for preparation for the following color image forming.

Toners used for redeveloping during the aforementioned releasing of the cleaning blade stay again within a region related to image forming, resulting in an adverse effect on color images.

In the case of a mono-color image forming apparatus (not illustrated), on the contrary, it is possible to keep causing the cleaning blade to be in pressure-contact with an entire region related to image forming because it is not necessary to superimpose toner images each having a different color on the circumferential surface of the photoreceptor drum. Therefore, it does not happen that redeveloping caused by pressure-contact and releasing of the cleaning blade affects adversely on images. Further, an amount of residual toners is less on the mono-color image forming apparatus than on the color image forming apparatus of a multi-color type. Therefore, redeveloping does not affect adversely on images in the case of the mono-color image forming apparatus.

On an image forming apparatus of a multi-color type, therefore, neutralizing voltage for neutralizer 115 is made to be those wherein D.C. voltage that is the same in polarity as transfer voltage and is appropriate in voltage is superposed on A.C. bias voltage, so that there may be no difference in voltage between photoreceptor drum 110 and residual toner, for excellent cleaning.

Even in the case of a color image forming apparatus having the multi-color function wherein a plurality of developing units are provided around a photoreceptor drum and toner images each having a different color are superimposed and formed on the surface of the photoreceptor drum after repetition of the process of charging, imagewise exposure and developing and then are transferred onto a recording sheet, it is not necessary to redevelop on a multi-color basis when images on a document are characters. In addition to a multi-color mode, therefore, there is provided a mono-color mode wherein only one of a plurality of developing units each containing different color developer is operated and a process including charging, imagewise exposure, developing and transfer that immediately follows the developing is taken. In the case of a multi-color mode, it is not possible to form a multi-color image whose length exceeds one circumference of a circle of the photoreceptor drum but is possible, in the case of a mono-color mode, to record an image whose size exceeds one circumference of a circle of the photoreceptor drum as shown in FIGS. 2 (*a*) and 2 (*b*). In FIG. 2 (*a*), the numeral 10 represents a circumferential surface of the photoreceptor drum, and dotted line portions D (A)–D (C) represent regions where images were formed on the circumferential surface of the photoreceptor drum, while ranges D (B)–D (C) represent a portion where images were formed twice. FIG. 2 (*b*) shows a recording sheet on which P (A) corresponds to D (A) in image forming and P (C) corresponds to D (C).

In this case, when corona discharge impressed by a neutralizer is conducted under the same condition as in a multi-mode in recording an image whose size exceeds one circumference of a circle of the photoreceptor drum, ranges D (B)–D (C) where image forming was conducted twice for one image sometimes show thereon a photographic fog.

The reason for the foregoing is as follows. Since neutralizing voltage in the multi-color mode is one wherein D.C. voltage that is the same in polarity as transfer voltage and is appropriate in voltage is superposed on A.C. bias voltage, the D.C. voltage that is opposite in polarity to charging voltage affects adversely on charging characteristics. Ranges where image forming is conducted twice on the circumferential surface of the photoreceptor drum for one image, in particular, show remarkable adverse effect on charging characteristics caused by bias voltage of a neutralizer. Therefore, occurrence of photographic fog is observed on the region where image forming is conducted twice for one image.

An object of the invention is to provide an image forming apparatus capable of forming an excellent image under a mono-color mode as well as a multi-color mode.

Further object of the invention is to provide an image forming apparatus capable of forming an excellent image independently of the size of an image to be recorded.

SUMMARY OF THE INVENTION

The invention attains the object mentioned above and provides an image forming apparatus comprising, around a photoreceptor drum, at least a charging unit, means for imagewise exposure, a plurality of developing units, a transfer belt device, a neutralizing unit and a cleaning unit so that the photoreceptor drum from which a toner image formed thereon has been transferred on a recording sheet may be neutralized by the neutralizing unit and then cleaned by the cleaning unit, wherein a plurality of neutralizing voltages can be set on the neutralizing unit mentioned above. In the preferable embodiment, the neutralizing voltage to be set can be switched between a multi-color mode and a mono-color mode or depending on a size of a recording sheet.

DETAILED DESCRIPTION OF THE INVENTION

First, the structure and operations will be explained.

Figure 1:
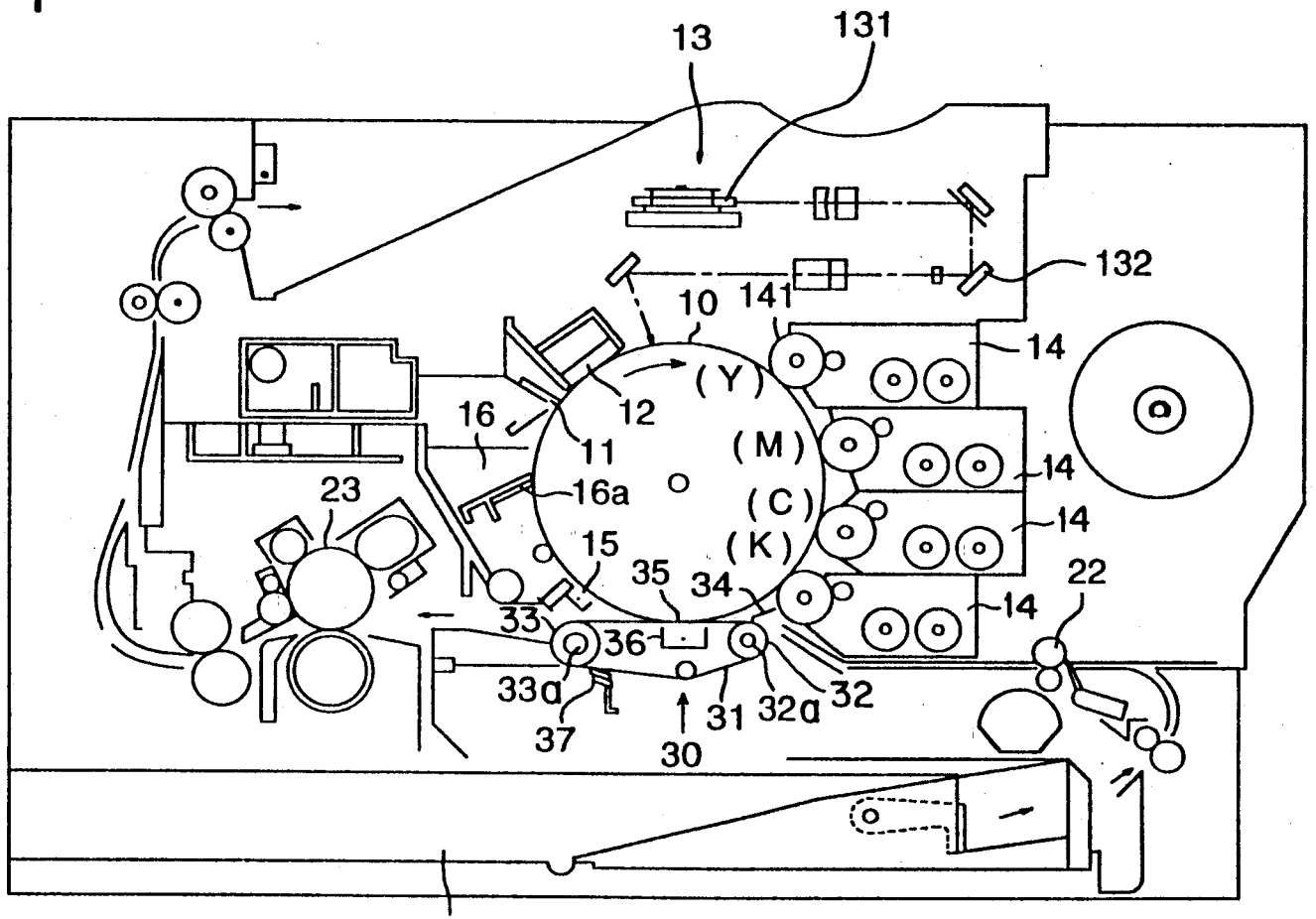
FIG. 1 is a structural section showing an example of an image forming apparatus of the invention.

FIG. 1 shows a color image forming apparatus related to the invention. There will be explained as follows a case wherein images are formed through a multi-color mode of four colors.

In FIG. 1, the numeral 10 represents a photoreceptor drum which is an image carrier which is made by coating an OPC light-sensitive layer on the drum, and it is rotated clockwise while being grounded. The numeral 12 is a scorotron charging unit through which uniform charging of $V_H$ (−600−−800 V) is given to the surface of photoreceptor drum 10 through corona discharge by means of a grid kept at $V_G$ (−550−−850 V) in voltage and a corona discharge wire. Prior to charging by means of the scorotron charging unit 12, the surface of the photoreceptor is neutralized, for eliminating it past record accumulated until the moment of a previous print, through exposure by means of PCL 11 wherein a light emitting diode is used. Concurrently with the foregoing, cleaning blade 16a of cleaning unit 16 is brought into pressure-contact for cleaning the circumferential surface of the photoreceptor, and then the cleaning blade 16a is released from its pressure-contact for preparation of the following color image forming.

After the photoreceptor is charged uniformly, it is subjected to imagewise exposure based on image signals conducted by imagewise exposure means 13. In the imagewise exposure means 13, a beam from an unillustrated light source of a laser diode passes through rotating polygon mirror 131 and an fθ lens and is deflected by reflection mirror 132 for scanning which forms a latent image together with rotation (subsidiary scanning) of the photoreceptor drum 10. In the present example, a character portion is subjected to exposure and a reversal latent image on which a character portion is on the lower voltage (−100 V-0) is formed.

Around the photoreceptor drum 10, there are provided developing units 14 containing respectively developer composed of yellow (Y) toner and carrier, that composed of magenta (M) toner and carrier, that composed of cyan (C) toner and carrier and that composed of black (K) toner and carrier, and in the case of a full color mode, development for the first color is conducted first by developing sleeve 141 having magnets built-in and rotates while holding developer. The developer is composed of a carrier a particle of which has a core of ferrite that is coated with insulating resin and of toner whose primary material is polyester to which a pigment corresponding to a color of the toner, a charge controlling agent, silica and titanium oxide are added. The developer is regulated to 300–600 μm in thickness on the developing sleeve 141 by a layer forming bar to be conveyed to a developing section.

A clearance between the developing sleeve 141 and the photoreceptor drum 10 at the developing section is made to be 0.4–1.0 mm which is greater than a thickness of a layer (developer), and AC bias of $V_{AC}$ (1.5–3.0 $KV_{p-p}$) and DC bias of $V_{DC}$ (−500−−700 V) are superimposed and impressed on the clearance mentioned above. Since $V_{DC}$, $V_H$ and charging on toner are of the same polarity, toner which is given a chance by $V_{AC}$ to leave from carrier does not adhere to the portion of $V_H$ that is higher than $V_{DC}$ in terms of voltage but adheres to the portion of $V_L$ that is lower in voltage than $V_{DC}$ for visualization (reversal development).

After the completion of visualization for the first color, the sequence enters an image forming process for the second color, and uniform charging by means of scorotron charging unit 12 is conducted again, and a latent image based on image data for the second color is formed by imagewise exposure means 13. In this case, neutralizing by means of PCL 11 which was conducted in the image forming process for the first color is not conducted because toner sticking to the image portion for the first color scatters due to the rapid fall in voltage taking place in the neighborhood of the toner.

Among entire surface of the photoreceptor drum 10 where the voltage is $V_H$, on the portion where no image was formed for the first color, a latent image identical to that for the first color is formed and developed, while on the portion where an image for the first color exists and development is conducted again, a latent image of $V_M$ is formed owing to light-shielding caused by toner for the first color and to electric charges owned by the toner itself and development corresponding to voltage difference between $V_{DC}$ and $V_M$ is conducted. On the portion where an image for the first color is superposed on that for the second color, the voltage is sometimes made to be intermediate voltage satisfying $V_H > V_M$ (−100−−300 V) $> V_L$ by reducing amount of exposure for the first color, because balance for the first color and the second color is lost when development for the first color is conducted after a latent image of $V_L$ is formed.

For the third and fourth colors, image forming processes identical to that for the second color are conducted, thus, four visual images each having a different color are formed on the surface of the photoreceptor drum 10.

Only an image portion having toner sticking thereto on the surface of the photoreceptor carrying a multicolor toner image thus formed is sometimes subjected to exposure so that excellent transfer free from transfer troubles such as repelling may be carried out.

On the other hand, recording sheet fed out of sheet-feeding cassette 21 by sheet-feeding mechanism 22 is transported by transfer belt device 30 wherein transfer belt 31 is stretched to a transfer section where a multicolor image on the surface of the photoreceptor drum 10 is transferred on the recording sheet at a time.

The transfer belt 31 is an endless rubber belt having a resistance of $10^6$–$10^{14}$ Ω·cm and a thickness of 0.4–1.0 mm, wherein its basic material is urethane rubber and an FLC layer is formed on its outside. For preventing skewing of the belt during its rotation, a rib is sometimes provided on the lateral edge of the belt.

Incidentally, a belt having a high resistance such as a PET film or a film on which PET is coated may also be used provided that a neutralizing mechanism is provided.

On shaft 32a of supporting roller 32 located at the upstream side among supporting rollers 32 and 33 around which the transfer belt 31 is stretched, voltage of $V_{PC}$ (1.0–3.0 KV) is impressed. On the shaft 32a, conductive brush 34 which serves as a means for giving electric charges to recording sheet is grounded through the transfer belt 31 at the position for grounding, or grounded through a non-linear element resistor. The recording sheet which has been transported enters between the brush 34 and the transfer belt 31, and electric charges are given from the brush 34 to the recording sheet, thus an attractive force is generated between the recording sheet and the transfer belt 31. After this, the recording sheet enters nip portion (transfer section) 35 formed by both the photoreceptor drum 10 and the transfer belt 31 where a transfer electric field is given from the reverse side of the transfer belt 31 by means of corona discharge unit 36 or a bias roller in place of the corona discharge unit and thereby a multi-color image is transferred onto the recording sheet.

The recording sheet separated from the photoreceptor drum 10 is then separated from the transfer belt 31 after being neutralized by means of corona discharge with shaft 33*a* of the supporting roller 33 located at the downstream side to support the transfer belt 31 as an opposing electrode, or while being subjected to AC corona discharge. The numeral 37 is a cleaning blade which removes toner sticking to the rotating transfer belt 31. In the course of forming a multi-color image, the transfer belt 31 of transfer belt device 30 is kept away from the photoreceptor drum 10 after being swiveled around shaft 33*a* of supporting roller 33 that is located at the downstream side.

The recording sheet separated from the transfer belt device 30 and carrying a multi-color image is transported to fixing unit 23 composed of two pressure rollers wherein at least one roller of them has therein a heater. In the fixing unit, toner sticking to the recording sheet is given heat and pressure by the pressure rollers and is fused to be fixed on the recording sheet, and then the recording sheet is ejected out of the apparatus.

Remaining toner still staying on the surface of the photoreceptor drum 10 after transfer is neutralized by neutralizing unit 15 capable of being set with a plurality of neutralizing voltages in the form of superimposed impression of 650 Hz, $V_{ACP\text{-}P}$ (8.7 KV) that is set as neutralizing voltage for a multi-color mode and DC voltage of $V_{DC}$ (+450 V). After that, the remaining toner arrives at cleaning unit 16 where the remaining toner is scraped away by cleaning blade 16*a* that is made of rubber material and is kept in contact with the photoreceptor into the cleaning unit 16 (prior to this, the cleaning blade 16*a* is brought into pressure-contact with the photoreceptor at the appropriate moment) to be stored in a collecting box after being ejected out by a screw or the like. Incidentally, the neutralizing unit 15 mentioned above can serve also as a neutralizing unit for a recording sheet as shown in FIG. 1, depending on its location.

The photoreceptor drum 10 from which the remaining toner has been removed by the cleaning unit 16 is subjected to exposure by means of PCL 11 and then is subjected to uniform charging by means of scorotron charging unit 12, to enter the following image forming cycle. In the course of forming a multi-color image, the cleaning blade 16*a* is kept away from the surface of the photoreceptor, and AC neutralizing by means of neutralizing unit 15 is kept to be in the state of off.

The foregoing is an explanation on a process of a multi-color mode of four colors. Next, image forming on a mono-color mode on the color image forming apparatus mentioned above will be explained as follows.

After the uniform charging conducted by scorotron charging unit 12 on the surface of the photoreceptor drum 10, a reversal latent image is formed thereon by imagewise exposure means 13, and then the reversal latent image is subjected to reversal development made by one of developing units 14 set in advance (for example, developing unit 14 (K) containing developer consisting of black (K) toner and a carrier) so that a toner image may be formed. In order to prevent sticking of toner to the surface of the photoreceptor drum 10 and color mixture, developing units 14 (Y), 14 (M) and 14 (C) other than the developing unit 14 (K) are not driven for rotation and DC bias voltage of $V_{DC}$ only is impressed as a developing bias voltage. The toner image formed on the photoreceptor drum 10 is transferred onto recording sheet which is fed out of sheet-feeding cassette 21 and transported to a transfer section while sticking to the transfer belt 31 that moves synchronously.

For transferring, a transfer electric field is given, from the reverse side of the transfer belt 31, by corona discharge unit 36 or by a bias roller in place of the corona discharge unit. The recording sheet after being subjected to transferring is separated from the surface of the photoreceptor drum 10 and transported to fixing unit 23 where toner sticking to the recording sheet is fixed thereon, and the recording sheet is ejected out of the apparatus.

On the other hand, the photoreceptor drum 10 having thereon remaining toner after toner images thereon have been transferred is subjected to neutralizing made by neutralizing unit 15. In the present example, AC corona discharge under the conditions of 650 Hz and $V_{ACP\text{-}P}$(8.7 KV) is given on neutralizing conditions in a mono-color mode which are set to be different from those for a multi-color mode.

The photoreceptor drum 10 after being subjected to neutralizing is then cleaned by cleaning unit 16. The photoreceptor drum 10 thus cleaned is subjected to exposure given by PCL 11 to be neutralized for the following image formation. In a mono-color mode, cleaning blade 16*a* of cleaning unit 16 is kept into pressure-contact with the photoreceptor drum until completion of cleaning on the circumferential surface of the photoreceptor drum from which toner images have been transferred, from the viewpoint of eliminating the past record of the photoreceptor, and the pressure-contact is not released on the half way of image forming.

In the case of a color image forming apparatus of a printer type as shown in FIG. 1, either an external command may select a multi-color mode or a mono-color mode, or the color image forming apparatus itself may select a multi-color mode or a mono-color mode with image signals inputted therein from the outside.

In either case, when a multi-color mode or a mono-color mode is selected, the neutralizing condition mentioned above corresponding to the selected mode is established.

Next, there will be explained a case wherein neutralizing conditions are changed depending on the image size in a monocolor mode.

Figure 2:
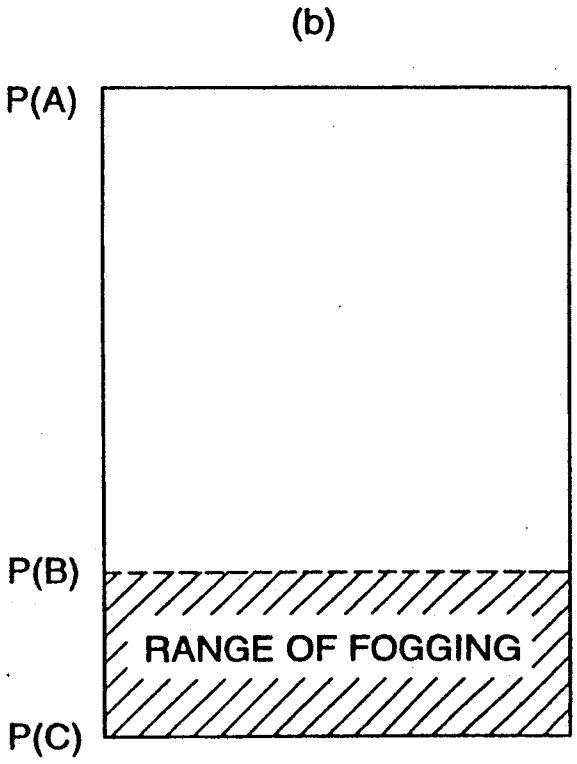
FIGS. 2(*a*) and 2(*b*) are illustrations of images formed respectively on a photoreceptor drum and a recording sheet.
Figure 2:
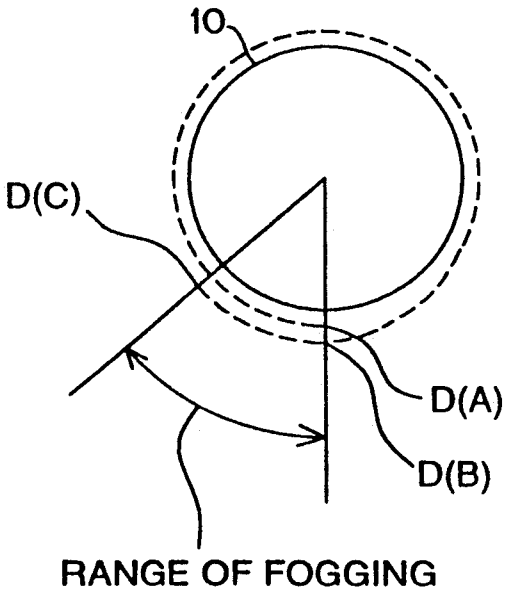

As shown in FIGS. 2 (*a*) and 2 (*b*), it is possible to form on a recording sheet an image whose length is greater than the circumference of the photoreceptor drum in a mono-color mode. When corona discharge to be impressed by the neutralizing unit 15 was made to be a condition for a multi-color mode, occurrence of photographic fog was observed on the range from D(B) to D(C) (the range from P(B) to P(C) on a recording sheet) where image formation was conducted twice for one image. However, when corona discharge to be impressed by the neutralizing unit 15 was made to be a condition for a mono-color mode, no fog was observed on the entire range D(A)–D(C) (P(A)–P(C) on recording sheet) as well as on the range where image formation was conducted twice. In a mono-color mode, it is possible to keep the cleaning blade 16*a* in pressure-contact to cover the entire region on the circumferential surface of the photoreceptor drum related to image forming. Therefore, neutralizing voltage does not need to be one wherein D.C. voltage that is the same in polarity as transferring voltage and is appropriate in voltage is superposed on A.C. bias voltage as in the case of a multi-color mode.

Figure 3:
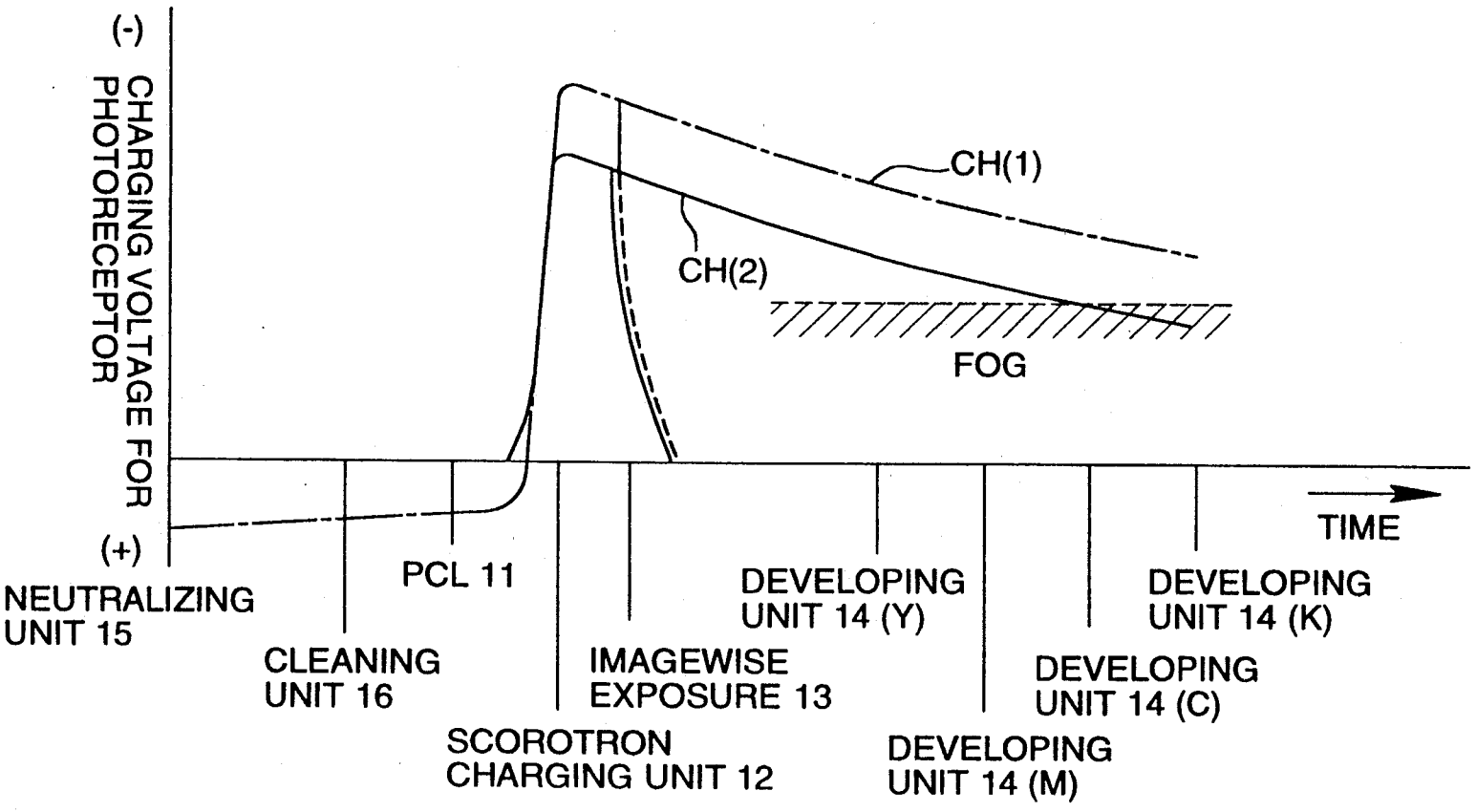
FIG. 3 represents curves showing surface potentials on the photoreceptor drum.
Figure 4:
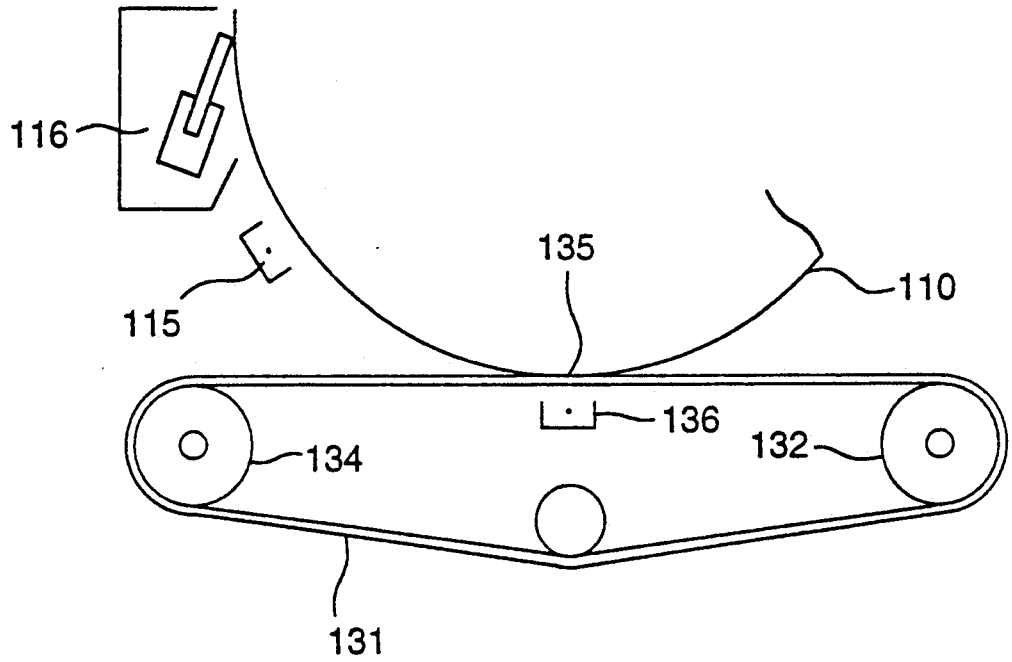
FIG. 4 PRIOR ART
FIG. 4 is an illustration showing how the conventional transfer belt device and the neutralizing unit are structured.

FIG. 3 shows how potential on the surface of the photoreceptor changes when neutralized by AC bias voltage having DC components with the same polarity as that of transfer voltage, and CH (1) represents electric potentials on the portion where the first image formation is conducted on the photoreceptor drum 10 for one image, while CH (2) represents those on the portion where the second image formation is conducted. In the present example, the portion for the second image information on the photoreceptor to be charged with electricity negatively is charged positively by a neutralizing unit. The positive charges on the above-mentioned portion are not neutralized despite exposure by means of PCL 11 after cleaning, though negative charges are neutralized. Therefore, the portion arrives, in the state of being charged positively, at scorotron charging unit 12 Compared with the first charging (CH (1)) with zero voltage, charged voltage after the second charging (CH (2)) is lower by the amount of positive charging. With regard to the portion where no imagewise exposure is given, dark decay takes place thereon and then the portion arrives at developing unit 14 (K) to be developed, and voltage there is already as low as in a zone of fog, which is shown in the figure. This is also apparent from less fog caused by developing unit 14 (14 (Y) in the example) conducting monochromatic development that is positioned to be closer to scorotron charging unit 12.

Due to the known technology, it is possible to know in advance the length of the circumference of a circle of the photoreceptor drum, and it is also possible to know the size of recording sheets loaded in a sheet feeding cassette or the size of recording sheets selected. Further, in the case of a color image forming apparatus of a printer type as shown in FIG. 1, the size of recording sheets is sometimes instructed from the outside.

In the case of a mono-color mode, therefore, it is possible to judge in advance whether an image that is longer than the length of the circumference of a circle of the photoreceptor drum is formed on a recording sheet or not, and thereby it is possible to change the neutralizing conditions accordingly. To be concrete, when forming an image longer than the length of the circumference of a circle of the photoreceptor drum, neutralizing conditions used in the case of a multi-color mode may be established, while in other cases, neutralizing conditions used in a mono-color mode may be established.

Incidentally, a sheet for OHP may also be used as a transfer material.

As explained above, the invention has realized an image forming apparatus wherein a plurality of neutralizing voltage may be set, excellent cleaning is conducted, no fog is caused on an image and an excellent image can be obtained when neutralizing voltage is changed between a multi-color mode and a mono-color for recording on a large-sized recording sheet.

What is claimed is:

1. An image forming apparatus comprising:

a photorecepter means;

means for producing a latent image on said photorecepter means;

a plurality of developing means, each of said developing means developing said latent image and forming a toner image on said photorecepter means;

means for selecting one of a multi-color mode which selects at least two of said developing means to superimpose a plurality of toner images on said photorecepter means, and a mono-color mode which selects one of said developing means to form a mono-color toner image on said photorecepter means;

means for transferring said plurality of toner images or said mono-color toner image onto a recording medium;

means for neutralizing said photorecepter means to impress a neutralizing voltage;

means for cleaning a residual toner on said photorecepter means; and means for changing said neutralizing voltage according to said selection in said selecting means.

2. The image forming apparatus of claim 1, wherein said changing means sets a first predetermined neutralizing voltage when said multi-color mode is selected, and sets a second predetermined neutralizing voltage when said mono-color mode is selected.

3. The image forming apparatus of claim 1, wherein said changing means sets a first predetermined neutralizing voltage when a size of said recording medium exceeds a size of said photoreceptor means in said mono-color mode.

* * * * *